US007527061B2

(12) United States Patent
Kim et al.

(10) Patent No.: US 7,527,061 B2
(45) Date of Patent: May 5, 2009

(54) DISHWASHER AND METHOD FOR CONTROLLING THE SAME

(75) Inventors: Yong Gu Kim, Seoul (KR); Tae Hee Kwak, Incheon (KR)

(73) Assignee: LG Electronics Inc., Seoul (KR)

( * ) Notice: Subject to any disclaimer, the term of this patent is extended or adjusted under 35 U.S.C. 154(b) by 459 days.

(21) Appl. No.: 11/095,561

(22) Filed: Apr. 1, 2005

(65) Prior Publication Data

US 2006/0076037 A1 Apr. 13, 2006

(30) Foreign Application Priority Data

Oct. 12, 2004 (KR) ..... 10-2004-0081422

(51) Int. Cl.
*B08B 3/00* (2006.01)
*B08B 3/04* (2006.01)

(52) U.S. Cl. ..... 134/56 D; 134/58 D; 134/104.4; 134/134; 134/10; 134/18

(58) Field of Classification Search ..... 134/104.4, 134/10, 56 D, 58 D, 18
See application file for complete search history.

(56) References Cited

U.S. PATENT DOCUMENTS 6,103,017 A * 8/2000 Thies et al. ..... 134/10

FOREIGN PATENT DOCUMENTS

KR 100316273 11/2001

OTHER PUBLICATIONS

U.S. Appl. No. 10/988,510 to Yoon et al., which was filed on Nov. 16, 2004.
U.S. Appl. No. 10/976,912 to Yoon et al., which was filed on Nov. 1, 2004.
English Language Abstract of Korean 10-0316273.

* cited by examiner

*Primary Examiner*—Michael Cleveland
*Assistant Examiner*—Nicole Blan
(74) *Attorney, Agent, or Firm*—Greenblum & Bernstein, P.L.C.

(57) ABSTRACT

A dishwasher and a method for controlling the same are disclosed, the dishwasher including washing part comprising a sump for accommodating wash water for washing contaminated dishes, a washing pump for pumping wash water accommodated in the sump, and a filtering member for filtering contaminants contained in the wash water, a draining part for draining contaminants and wash water filtered by the washing part; and a contaminant disposal part for drying contaminants discharged from the draining part. The dishwasher in accordance with the present invention has a contaminant disposal part installed thereat for drying or fermenting contaminants, thereby minimizing environmental pollution. Since contaminants are prevented from being decayed, the dishwasher is sanitarily used.

19 Claims, 10 Drawing Sheets

PRIOR ART

DISHWASHER AND METHOD FOR CONTROLLING THE SAME

CROSS-REFERENCE TO RELATED APPLICATIONS

This application claims the benefit of Korean Application No. P2004-81422, filed on Oct. 12, 2004, which is hereby incorporated by reference as if fully set forth herein.

BACKGROUND OF THE INVENTION

1. Field of the Invention

The present invention relates to a dishwasher, and more particularly, to a dishwasher and a method for controlling the same.

2. Discussion of the Related Art

In general, a dishwasher is an apparatus for automatically washing dishes. Owing to the functions of washing, rinsing, drying, and storing dishes, the dishwasher greatly reduces housework.

A washing method of the dishwasher is divided into a shower type and a supersonic type. The shower type dishwasher is normally employed for domestic use. The shower type dishwasher washes dishes by spraying hot water on dishes put in a dish basket, the water in which detergent dissolved. A method for spraying water includes spraying using a propeller, and boring a plurality of holes on a pipe and rotating the pipe.

Referring to FIG. 1, a conventional dishwasher will be described hereunder. The conventional dishwasher includes a water collector 20 provided at a lower part of a tub that forms a space for dishwashing, at least one washing arm mounted at an upper part of the water collector 20, and a rack 40 provided at an upper part of the washing arm 30.

The water collector 20 includes a sump 21 for accommodating wash water, a washing pump 22 for pumping the wash water from the sump into the washing arm 30, a draining pump 25, and a channel guide 23 for guiding a part of the pumped wash water from the washing pump 22 to the washing arm 30.

A filtering member 26 for filtering garbage included in the wash water (hereinafter, called contaminants) is mounted at the sump 21. A draining hose 27 is coupled with the draining pump 23 so as to discharge wash water to an outside thereof.

The filtering member 26 is generally divided into an automatic type for automatically discharging contaminant along with the wash water during the draining process, and a manual type that requires a user to remove contaminants. A working process of the dishwasher structured as mentioned above will be described as follows. The conventional dishwasher performs rough washing, main washing, rinsing and draining processes. Hereinafter, for convenience sake, the rough washing will be called a washing process.

When the washing process is started, the washing pump 22 pumps the wash water from the sump, and a part of the pumped wash water is moved to the washing arm 30 through the channel guide 23 so as to wash dishes. At the same time, the remainder of the wash water is guided by the channel guide 23 and flowed into the filtering member 26 so as to be filtered thereat. Thereafter, the wash water in the washing arm and the wash water in the filter member are all returned to the sump 21.

When the washing process is completed, the draining process is started. When the draining process is started, the draining pump 25 receives the wash water of the sump and drains to an outside thereof. In this instance, when the filtering member 26 is the automatic type, the wash water and the contaminants in the dishwasher are discharged outside through the draining hose 27. When the filtering member 26 is the manual type, the user needs to separate and remove the contaminants from the filtering member 26 after all the processes are finished.

The conventional dishwasher however has problems as follows. First, when a filtering member is an automatic type, contaminants are directly discharged from the dishwasher to an outside thereof. Therefore, an environmental pollution problem is raised. When the filtering member is a manual type, there is inconvenience that the contaminants need to be removed every time the dishes are washed. Second, since the contaminants of the dishwasher are decayed, a bad smell is generated and decayed water may flow down. Therefore, a user is exposed to an unsanitary environment.

SUMMARY OF THE INVENTION

Accordingly, the present invention is directed to a dishwasher that substantially obviates one or more problems due to limitations and disadvantages of the related art.

An object of the present invention is to provide a dishwasher enabling to dispose contaminants of the dishwasher, thereby reducing environmental pollution.

Another object of the present invention is to provide a dishwasher and a method for controlling the same, the dishwasher used sanitarily and thereby preventing contaminants from decaying.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a dishwasher includes a washing part, a draining part for draining contaminants and wash water filtered by the washing part, and a contaminant disposal part for drying contaminants discharged from the draining part, wherein the washing part includes a sump for accommodating wash water for washing contaminated dishes, a washing pump for pumping wash water accommodated in the sump, and a filtering member for filtering contaminants contained in the wash water.

The draining part includes a draining pump connected with the washing part, a first draining hose for discharging the contaminants and wash water collected at the draining pump to the contaminant disposal part, a second draining hose for discharging wash water from the draining pump to an outside of the dishwasher, and a channel control valve for selectively supplying the wash water to the first draining hose and the second draining hose.

In more detail, the second draining hose is preferably installed at a predetermined portion of the first draining hose, and the channel control valve is installed at a coupling part of the first and second draining hoses.

The contaminant disposal part includes a disposal tank for accommodating contaminants discharged from the draining part, a stirrer for mixing contaminants in the disposal tank, a driving device for rotating the stirrer, and a heating device for drying the contaminants.

Preferably, the driving device rotates the stirrer and the disposal tank at the same time.

Preferably, the disposal tank includes a body having a plurality of through holes, and a screen installed at a side of the body to discharge moisture contained in the contaminants.

Preferably, the driving device includes a dehydrating axis coupled with the disposal tank, a stirring axis installed in the dehydrating axis and coupled with the stirrer, a speed reducer installed in the dehydrating axis and coupled with the stirring axis to reduce a rotation speed of the stirrer, a clutching device for controlling coupling of the dehydrating axis and the stirring axis, and a driving motor coupled with the stirring axis.

Preferably, the heating device includes a drying heater installed at an upper part of the disposal tank and generating heat, and a fan for blowing heat from the drying heater into the disposal tank.

The heating device may include a drying heater attached to an outer surface of the disposal tank to heat the disposal tank, and a fan for circulating air in the disposal tank. In more detail, the drying heater heats the disposal tank by an induction heating method.

The contaminant disposal part further includes a cover to be opened or closed for throwing contaminants into the disposal tank.

The disposal tank includes a water tank at a lower part thereof so as to collect moisture discharged from the disposal tank.

In another aspect of the present invention, a dishwasher includes a washing part including a sump for accommodating wash water for washing contaminated dishes, a washing pump for pumping wash water from the sump, a filtering member for filtering contaminants included in the wash water.

The draining part includes a draining pump connected with the washing part, a first draining hose for discharging the contaminants and wash water collected at the draining pump to the contaminant disposal part, a second draining hose for discharging wash water from the draining pump to an outside of the dishwasher, and a channel control valve for selectively supplying the wash water to the first draining hose and the second draining hose.

Yet, in another aspect of the present invention, a contaminant disposal part includes a disposal tank for accommodating contaminants discharged from the draining part, a stirrer for mixing contaminants in the disposal tank, a fermentative bacteria inserting device for inserting the fermentative bacteria into the disposal tank, a driving device for rotating the stirrer, and a heating device for maintaining the contaminants at a predetermined temperature so as to ferment the contaminants received in the disposal tank.

Preferably, the driving device rotates the stirrer and the disposal tank at the same time.

Preferably, the disposal tank includes a body having a plurality of through holes, and a screen installed at a side of the body to discharge moisture contained in the contaminants.

Preferably, the driving device includes a dehydrating axis coupled with the disposal tank, a stirring axis installed in the dehydrating axis and coupled with the stirrer, a speed reducer installed in the dehydrating axis and coupled with the stirring axis to reduce a rotation speed of the stirrer, a clutching device for controlling coupling of the dehydrating axis and the stirring axis, and a driving motor coupled with the stirring axis.

Preferably, the heating device includes a drying heater installed at an upper part of the disposal tank and generating heat, and a fan for blowing heat from the drying heater into the disposal tank.

Preferably, the heating device includes a drying heater attached to an outer surface of the disposal tank to heat the disposal tank, and a fan for circulating air in the disposal tank.

Yet, in another aspect of the present invention, a method for controlling a dishwasher, including the steps of, discharging wash water and contaminants of a washing part to a disposal tank installed at a contaminant disposal part after a washing process for washing contaminated dishes, performing a rinsing process for rinsing the dishes after discharging the wash water and contaminants to the disposal tank, draining the wash water outside of the dishwasher after the rinsing process is completed, and drying the wash water and contaminants discharged to the disposal tank by using a stirrer and a heating device installed at the contaminant disposal part.

Preferably, the step of rinsing and draining wash water outside of the dishwasher is performed simultaneously with the step of drying contaminants.

Preferably, the method for controlling the dishwasher further includes a step of dehydrating moisture contained in the contaminants by rotating the disposal tank.

Preferably, in the dehydrating step, the disposal tank and the stirrer are rotated at a same speed.

Preferably, the heating device used in the drying step circulates heat into the disposal tank so as to dry contaminants, the heat generated from the drying heater that is installed at the contaminant disposal part.

The heating device used in the drying step may of course heat the disposal tank by an induction heating method.

The method for controlling the dishwasher further includes a step of inserting fermentative bacteria into the disposal tank.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
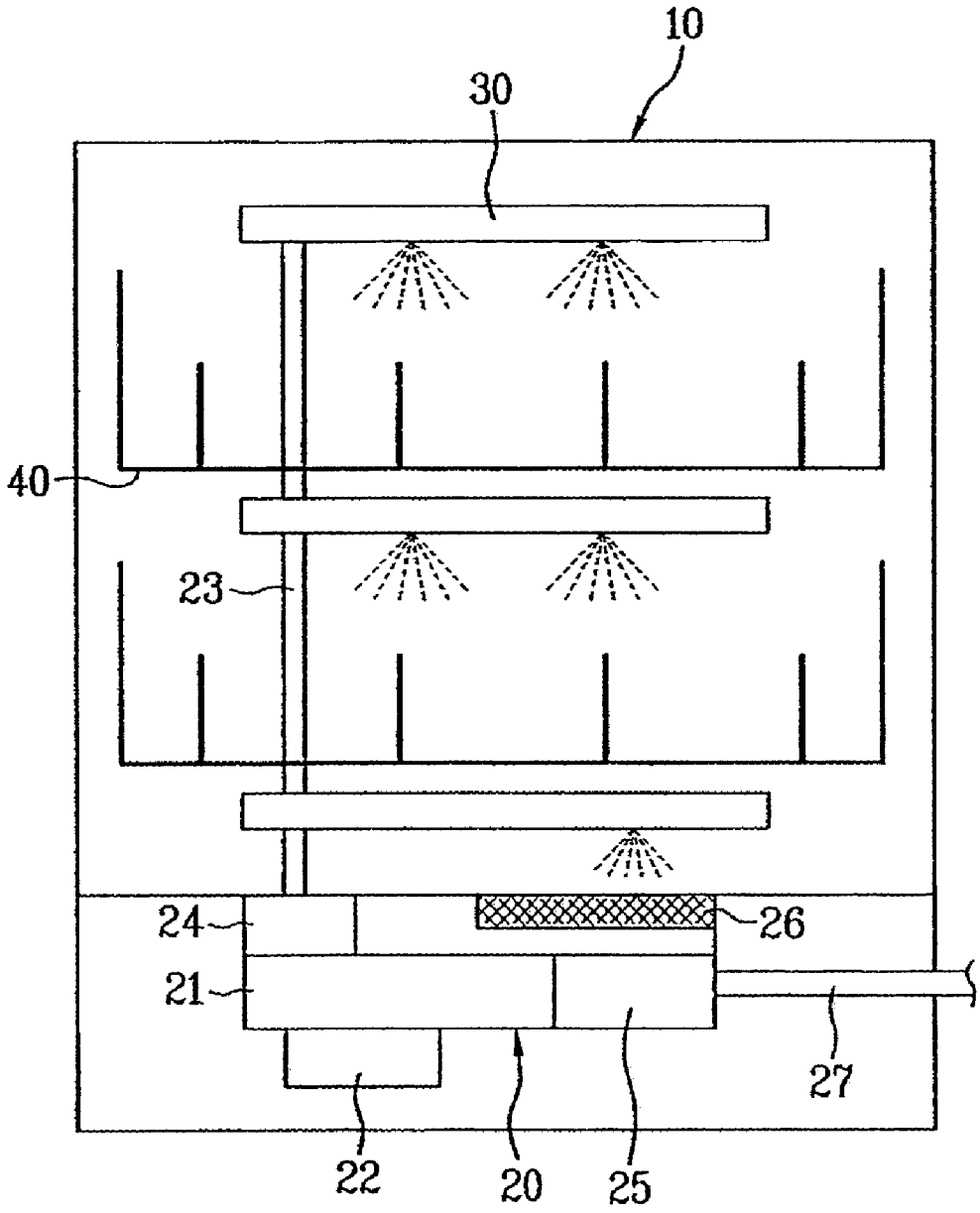
FIG. 1 illustrates a cross sectional view showing a structure of a conventional dishwasher.
Figure 2:
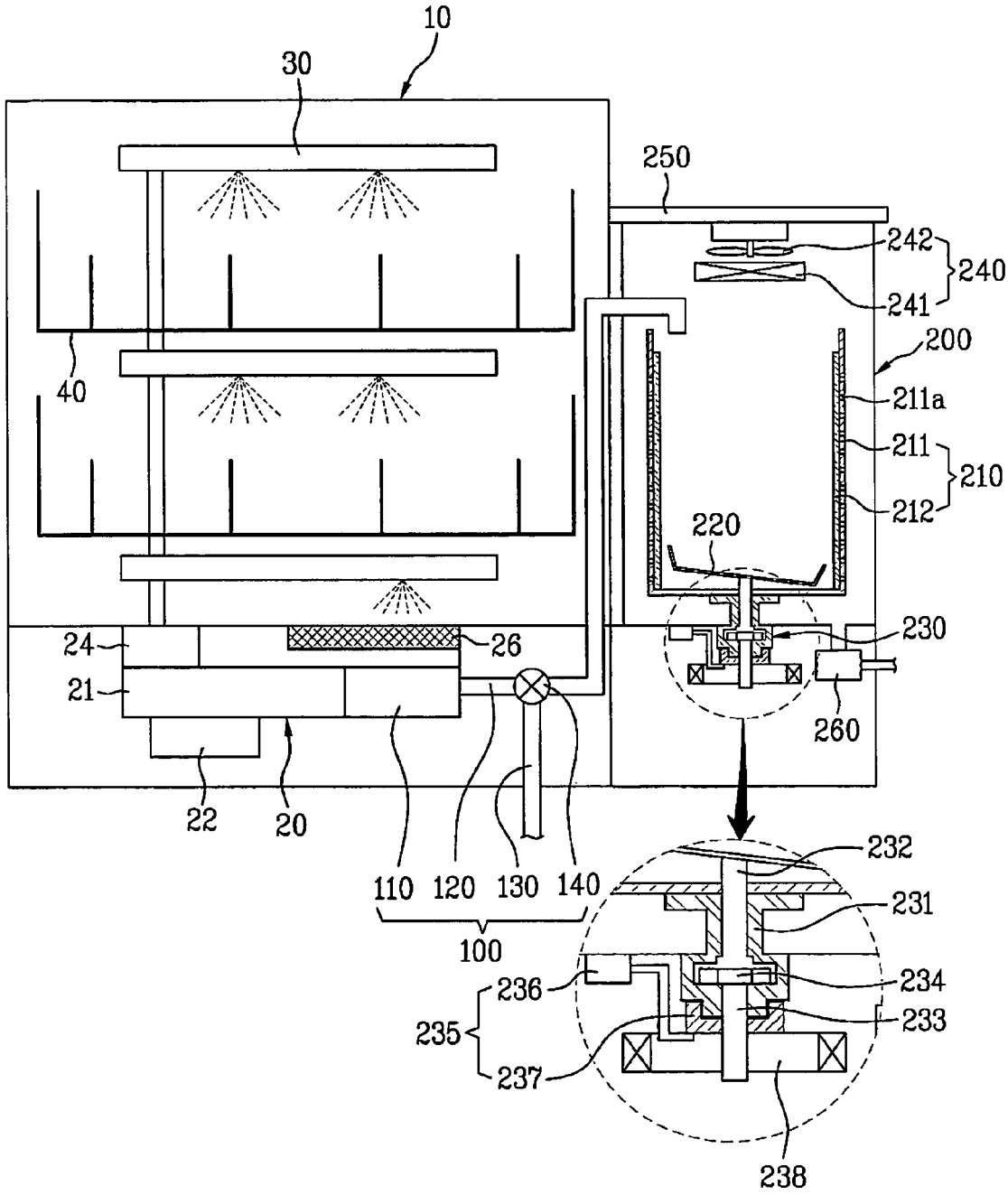
FIG. 2 illustrates a cross sectional view showing a first embodiment of a dishwasher in accordance with the present invention.

Referring to FIG. 2, a first embodiment of a dishwasher in accordance with the present invention will be described as follows. The dishwasher includes a washing part 10 for spraying wash water to wash dishes and filtering contaminants, a draining part 100 for draining wash water and contaminants filtered at the washing part, and a contaminant disposal part 200 for drying contaminants drained from the draining part.

The washing part 10 includes a sump 21 for accommodating wash water for washing contaminated dishes, a washing pump 22 for pumping wash water accommodated in the sump, and a filtering member 26 for filtering contaminants included in the wash water. Structural elements of the washing part are mostly the same as the structural elements of the dishwasher described in the related art.

The draining part 100 includes a draining pump 110 connected with the washing part 10, a first draining hose 120 for discharging the contaminants and wash water collected at the draining pump to the contaminant disposal part 200, a second draining hose for draining the wash water to an outside of the dishwasher, and a channel control valve 140 for selectively supplying the wash water to the first draining hose 120 or to the second draining hose 130.

In more detail, the draining hose 120 connects the draining pump 110 with the contaminant disposal part 200, the second draining hose 130 is mounted at a predetermined portion of the first draining hose 120 and the channel control valve 140 is mounted at a portion coupling the first draining hose 120 with the second draining hose 130.

The first and second draining hoses 120 and 130 may of course be separately coupled with the draining pump 110. In this instance, a valve for opening and closing the first and second draining hoses is mounted at an entrance of the wash water. The contaminant disposal part 200 includes a disposal tank 210 for accommodating contaminants discharged from the draining part 100, a stirrer for mixing the contaminants in the disposal tank, a driving device 230 for rotating the disposal tank and the stirrer, and a heating device 240 for drying the contaminants.

Since the disposal tank 210 needs to be mounted being capable of rotation, an outlet of the first draining hose 120 is desirably mounted at an upper part of the disposal tank 210. The contaminant disposal part 200 may be integrated into the washing part 10 and the draining part 100. The draining part 100 may of course be integrated into the washing part 10, or installed separately.

The disposal tank 210, the driving device 230, and the heating device 240 will be serially described. The disposal tank 210 includes a body 211 having a plurality of through holes 211*a*, and a screen 212 provided at a side of the body so as to discharge moisture included in the contaminants. The disposal tank 210 includes a space for accommodating contaminants and is rotated so as to play a role of discharging moisture included in contaminants. The body 211 desirably includes synthetic resin, plastic, or stainless steel so as to supplement intensity of the disposal tank 210. The screen 212 may include various materials. The body 211 and the screen 212 are desirably made of materials that resist gas or heat, the gas generated from the contaminants and the heat generated from the heating device 240.

Meanwhile, the screen 212 is mounted at an inner surface or an outer surface of the body 211. The screen 212 has a structure enabling to block a though hole 211*a* of the body. For example, a piece of the screen is mounted at each of the plurality of through holes 211*a* of the body, or on a whole surface of the body 211.

At a height of the disposal tank 210, at which moisture is best discharged by a centrifugal force, a relatively large number of the through holes 211*a* are formed, or the through holes are formed large in size, so as to increase efficiency in dehydration of the contaminants. The body may of course be formed in a porous form so as to be able to play a role of the screen.

The driving device 230 includes a dehydrating axis 231 axis-coupled with the disposal tank 210, stirring axes 232 and 233 coupled with the stirrer 220, a speed reducer 234 mounted in the dehydrating axis to reduce rotating speed of the stirring axis, a clutching device 235 controlling coupling of the dehydrating axis and the stirring axis, and a driving motor 238 coupled with the stirring axis.

The stirring axis includes upper and lower axes 232 and 233, and the speed reducer 234 is mounted between the upper and lower stirring axes so as to reduce a rotating speed of the stirring axis. The speed reducer 234 includes a sun gear (not shown) coupled with the lower stirring axis 233, and a planetary gear (not shown) geared to the sun gear and coupled with the stirring axis 232.

The speed reducer is enabled to reduce the rotation speed of the upper stirring axis 232 due to a gear ratio of the sun gear and the planetary gear. The clutching device 235 includes a coupling 237 installed to be movable up and down at the lower stirring axis 233, and a clutch 236 for moving the coupling up and down. In this instance, the coupling 237 is mounted to be movable up and down at the lower stirring axis 233.

When the coupling 237 is moved upward and geared with the dehydrating axis 231, the dehydrating axis 231 and the stirring axis 232 and 233 are rotated at a high speed. When the coupling 237 is moved downward and released from the dehydrating axis 231, only the upper stirring axis 232 is rotated at a low speed but the dehydrating axis 231 is stayed.

An inner rotor type having a rotor mounted in the center thereof, or an outer rotor type may be employed as the driving motor 238. A maximum capacity of the driving motor 238 is desirably determined based on rotation torque or rotation speed of the disposal tank 210. The driving device for driving the stirrer and the disposal tank may include various structures enabling to rotate the disposal tank 210 and the stirrer 220 separately. The heating device 240 includes a drying heater 241 mounted at an upper part of the disposal tank 210, and a fan 242 for blowing heat generated from the drying heater 241 into the disposal tank 210. The heating device 240 may of course include only the drying heater 241 to heat the disposal tank 210. The contaminant disposal part 200 includes a cover 250 for opening and closing the contaminant disposal part 200 so as to insert contaminants into the disposal tank 210.

Accordingly, contaminants filtered at the washing part 10 and contaminants received from outside are both dried. In this instance, the cover may be changed into various structures.

A water tank 260 is mounted at a lower part of the disposal tank 210 to collect moisture discharged during a dehydrating process and moisture condensed during a drying process. Process of the first embodiment about the dishwasher in accordance with the present invention will be described as follows. The washing part 10 carries out rough washing, main washing, discharging, rinsing, draining, dehydrating and drying processes. In this case, during the discharging process, wash water of the washing part 10 is discharged to the contaminant disposal part 200, and during the draining process, the wash water of the washing part 10 is drained to an outside of the dishwasher. The draining part 100 carries out discharging process after the rough washing. The rough washing may also be performed after the discharging process. In this case, after the rough washing, a lot of contaminants are contained in the wash water, and thus a relatively less amount of contaminants are contained in the wash water after the main washing process. Accordingly, after the main washing process, the discharging process or the draining process may be performed.

Figure 3:
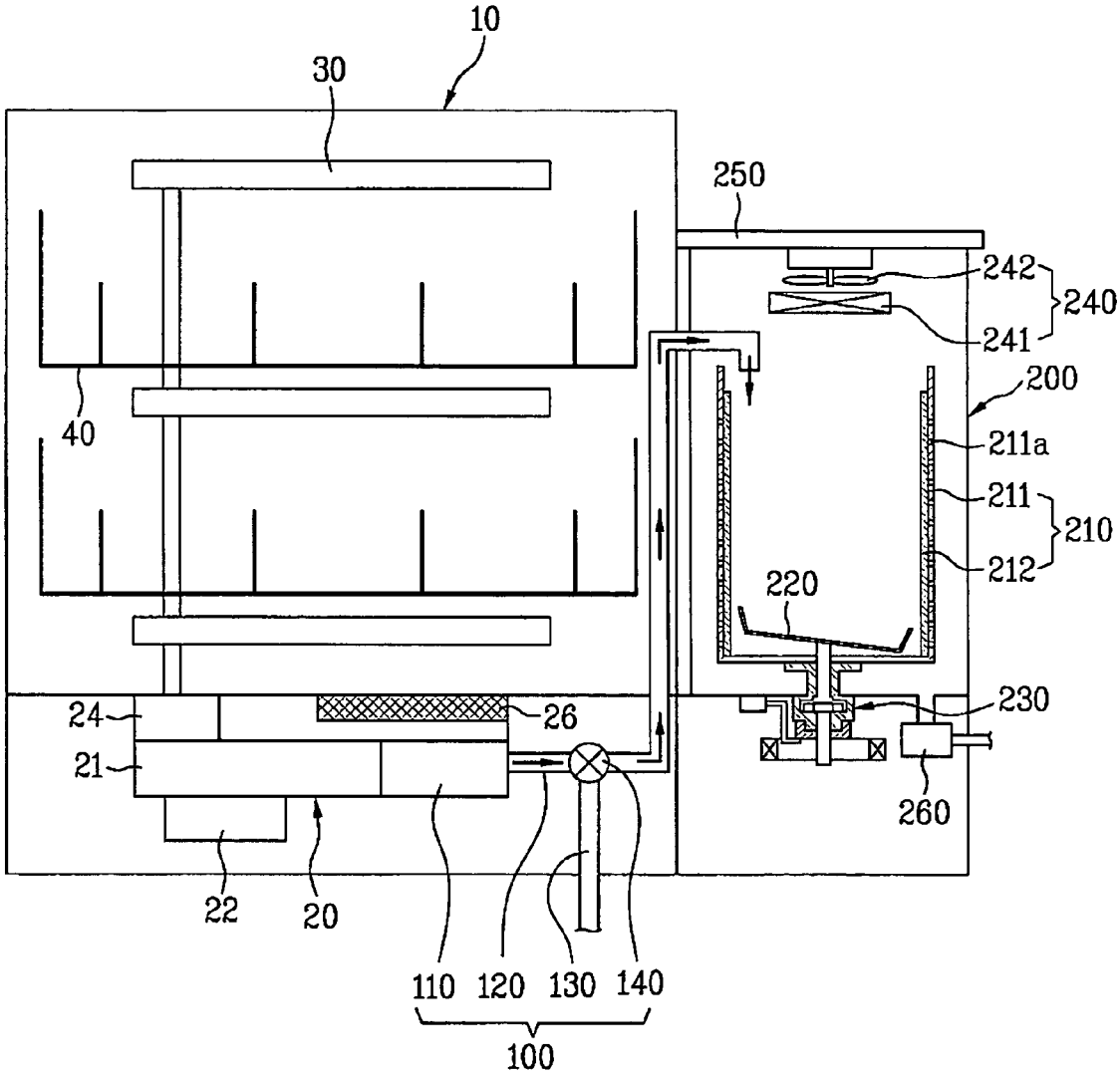
FIG. 3 illustrates a cross sectional view showing a draining process for draining wash water along with contaminants from the dishwasher of FIG. 2.

Dehydrating and drying processes of the contaminant disposal part 200 are performed simultaneously with the rinsing process of the washing part 10. After all the processes of the washing part are completed, dehydrating and drying processes of the contaminant disposal part may be performed. Referring to FIG. 3, a discharging process of the draining part in accordance with FIG. 2 will be described. When the discharging process of the draining part 100 is started, the draining pump 110 is driven so as to close the channel control valve 140 and the second draining hose 130. Accordingly, contaminants and wash water in the washing part are discharged through the first draining hose 120 to the disposal tank 210. In this instance, wash water is discharged through the plurality of through holes 211*a* of the disposal tank, and contaminants are filtered by the screen 212 so as to remain in the disposal tank 210.

Figure 4:
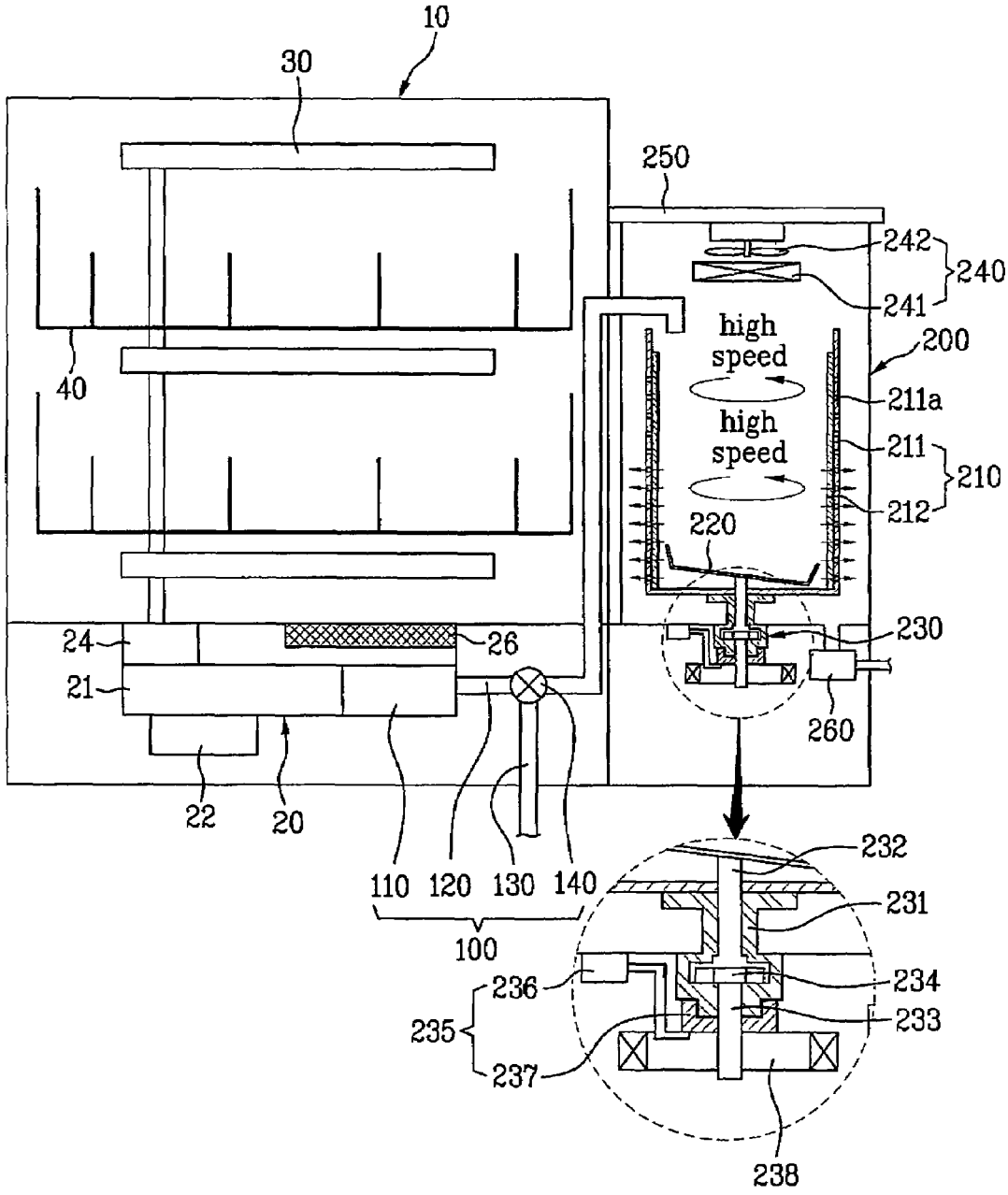
FIG. 4 illustrates a cross sectional view showing a dehydrating process of the dishwasher of FIG. 2.

Referring to FIG. 4, the dehydrating process of the contaminant disposal part in accordance with FIG. 2 will be described. When the dehydrating process of the contaminant disposal part 200 is started, the clutch 236 moves the coupling upward such that the coupling 237 and the dehydrating axis 231 are geared with each other. When the driving motor 238 is driven, the disposal tank 210 is rotated and the contaminants contained in the disposal tank holds the centrifugal force. Moisture contained in the contaminants is then discharged outside through the plurality of through holes 211*a* formed at the body of the disposal tank 210.

In this instance, the screen 212 installed at a side of the body 211 plays a role of passing the moisture contained in the contaminants and keeping the contaminants from being discharged. Moisture discharged to an outside of the disposal tank is collected at the water tank 260 installed at a lower part of the disposal tank.

Figure 5:
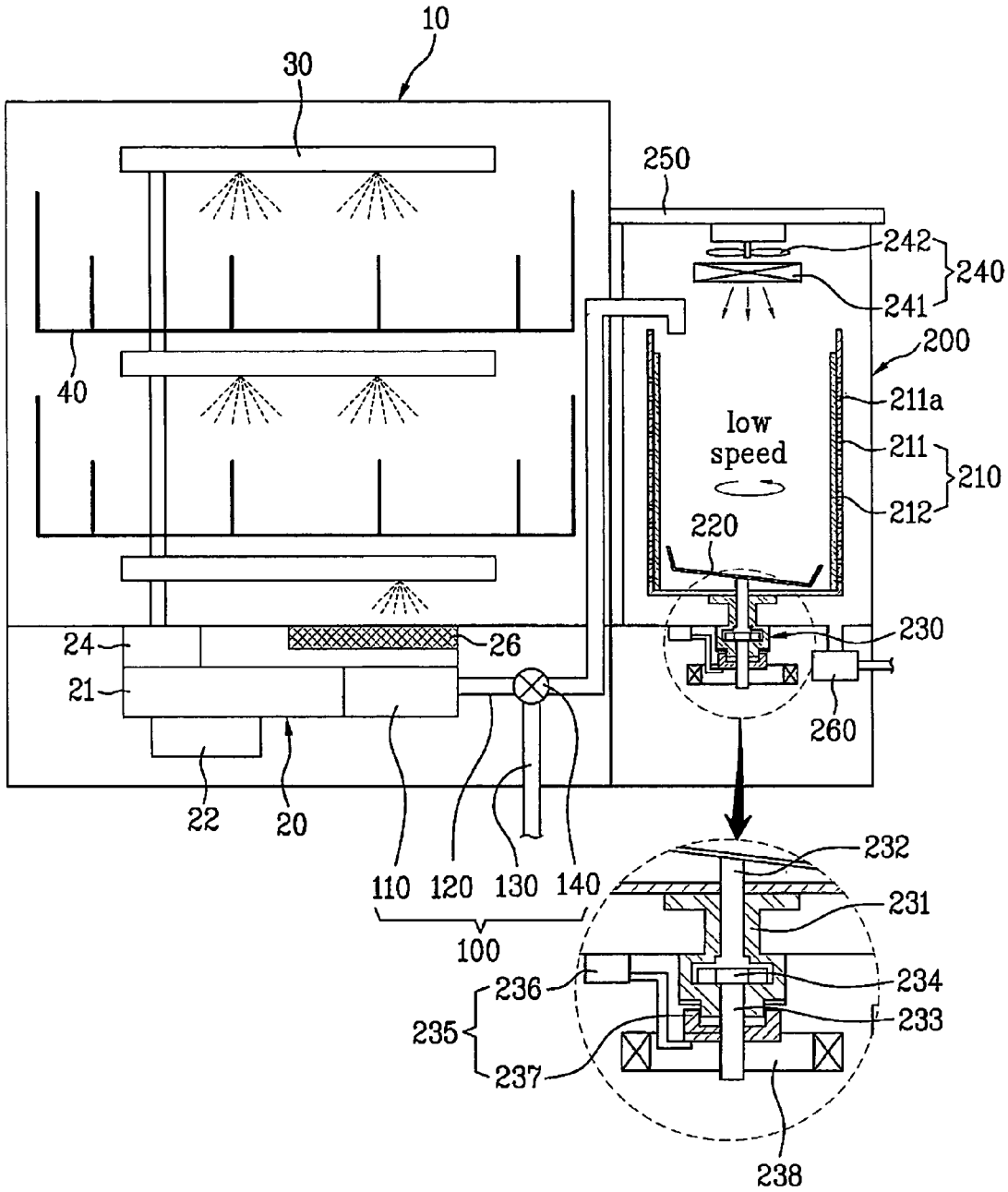
FIG. 5 illustrates a cross sectional view showing a dehydrating process of the dishwasher of FIG. 2.

Referring to FIG. 5, a drying process of the contaminant disposal part in accordance with FIG. 2 will be described. When the drying process of the contaminant disposal part 200 is started, the clutch 236 moves the coupling 237 downward so as to release connection between the coupling and the dehydrating axis 231. Then, the dehydrating axis 231 does not rotate but only the stirring axes 232 and 233 are rotated. In other words, the stirrer 220 rotates to stir the dehydrated contaminants stored in the disposal tank 210. In this instance, the stirrer 220 is driven at a speed lower than the rotation speed of the disposal tank 210 during the dehydration. When electric power is supplied to the drying heater 241, high temperature heat is generated and the fan 242 is rotated so as to transmit heat from the drying heater to the disposal tank. Therefore, the dehydrated contaminants are stirred and dried at a high temperature.

Figure 6:
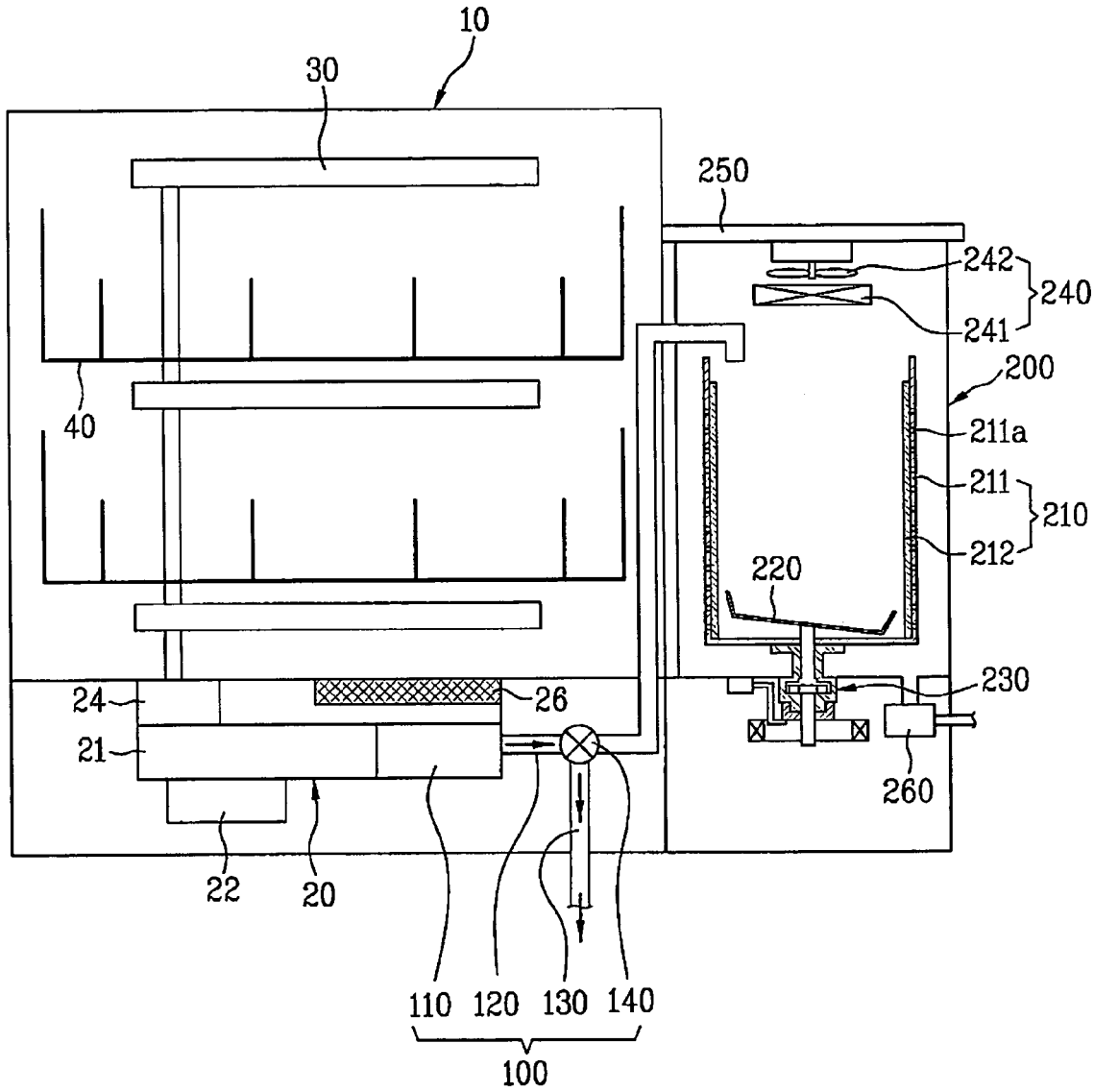
FIG. 6 illustrates a cross sectional view showing a draining process after a rinsing process of the dishwasher of FIG. 2.

Referring to FIG. 6, the draining process of the draining part in accordance with FIG. 2 will be described. When the draining process of the draining part 100 is started after the rinsing process, the draining pump 110 is driven, and the channel control valve 140 opens the second draining hose 130. Accordingly, wash water in the washing part 10 is discharged to an outside thereof through the second draining hose 130. After the washing process, the draining process is performed in the same way mentioned above.

A method controlling of the first embodiment related to the aforementioned dishwasher will be described as follows. First, when power is supplied to the dishwasher by a user, the dishwasher performs the washing process for washing contaminated dishes. When the washing process is completed, wash water in the washing part 10 is discharged to the disposal tank 210 installed at a contamination disposal 200.

Thereafter, a rinsing process for rinsing the dishes is performed. When the rising process is completed, wash water is drained to an outside of the dishwasher.

The contaminant disposal part 200 rotates the stirrer 220 and the disposal tank 210 installed thereat so as to dehydrate contaminants that are discharged into the disposal tank.

Figure 7:
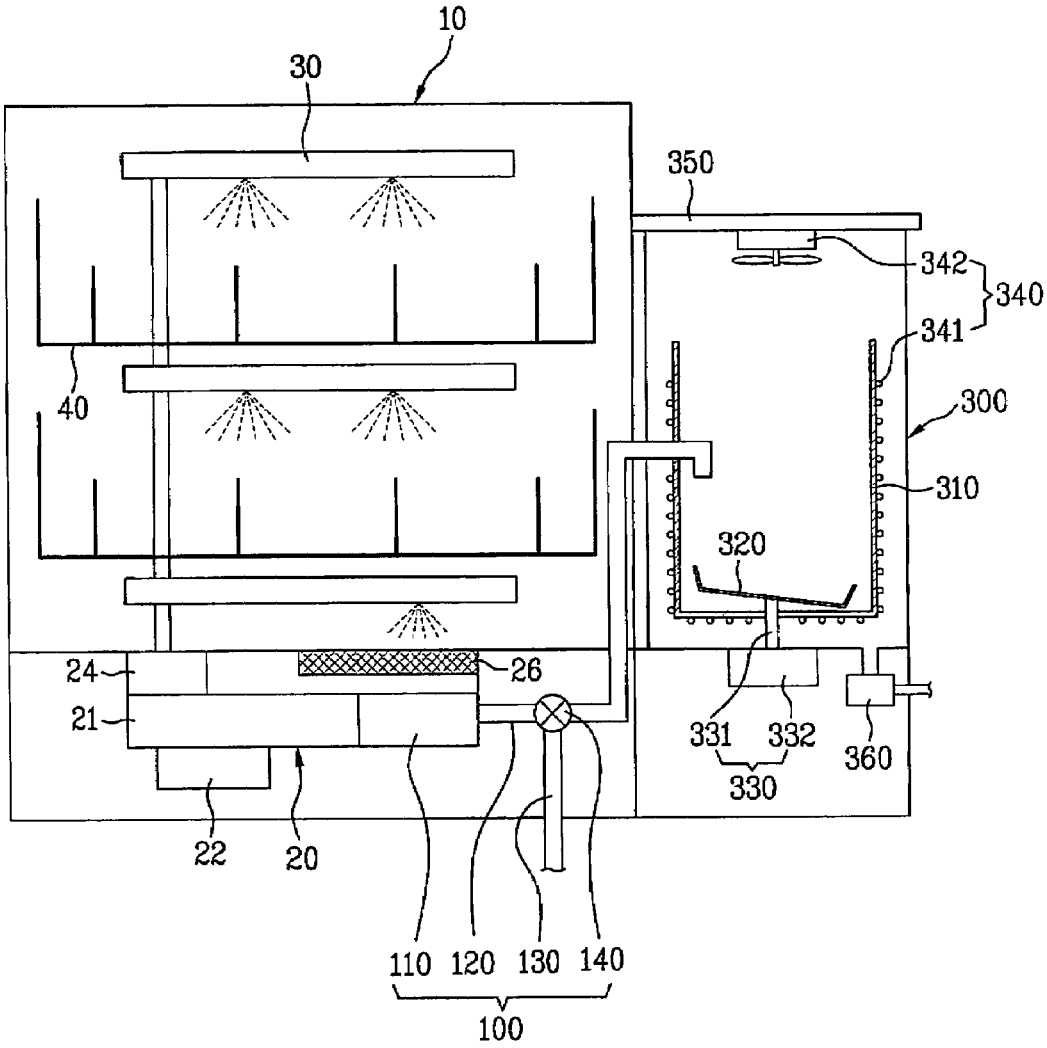
FIG. 7 illustrates a cross sectional view showing a second embodiment of the dishwasher in accordance with the present invention.

Then, the dehydrated contaminants are dried by the stirrer and the heating device 240 mounted at the contaminant disposal part 200. In this instance, the disposal tank 210 and the stirrer 220 are rotated at a same speed in the dehydrating step, and only the stirrer 220 is rotated at a low speed in the drying step. Rinsing and draining processes performed at the washing part are simultaneously performed with the drying process performed in the contaminant disposal part 200. The drying process may be performed after all the processes performed by the washing part. The heating device 240 employed in the drying step dries contaminants by circulating heat in the disposal tank, the heat generated from the drying heater 241 that is installed at the contaminant disposal part 200. Referring to FIG. 7, a second embodiment of the dishwasher in accordance with the present invention will be described. Structures of the washing part 10 and the draining part 100 in the dishwasher in accordance with the present invention are mostly the same as the first embodiment, and thus description of which will be omitted. The contaminant disposal part 300 in accordance with the second embodiment includes a disposal tank 310 for accommodating contaminants discharged from the draining part 100, a stirrer 320 for mixing the contaminants in the disposal tank 310, a driving device 330 for rotating the stirrer 320, and a heating device 340 for drying the contaminants.

The disposal tank 310 only functions to store the contaminants and wash water without rotation. Accordingly, an outlet of the first draining hose 120 installed at the draining part 100 is installed to pass through the disposal tank 310. The outlet of the first draining hose 120 is installed at an upper part of the disposal tank. The disposal tank 310 desirably includes a material that resists contaminants and gas generated from the disposal tank 310. The driving device 330 is coupled directly with the stirrer 320, or indirectly via a predetermined power transmitting means. A low speed motor rotated at a speed lower than that of the driving device of the first embodiment is employed because the driving device 330 rotates only the stirrer 320 at a low speed. Accordingly, a driving device having a capacity smaller than that of the driving device of the first embodiment is applied in the second embodiment.

The heating device 340 is installed on an outer surface of the disposal tank 310 and is configured to include a drying heater 341 for heating the disposal tank 310, and a fan 342 for circulating air in the disposal tank 310. In this instance, the drying heater 341 desirably heats the disposal tank 310 directly by an induction heating method so as to evenly heat the disposal tank in a short period of time. The induction heating method is for electrically heating an electric conductor by using an induction alternating current. The heating device may include only the drying heater for directly heating the disposal tank. The drying heater 341 includes a working coil wound around an outer surface of the disposal tank 310. In this instance, the drying heater is desirably covered by a heat conducting material so as to be prevented from being short circuited by moisture.

Not only the electromagnetism induction heating method but also various types of heating method can be used for a heating method of the drying heater 341 as long as the method enables directly heating the disposal tank 310.

The contaminant disposal part 300 further includes a cover 350 for throwing contaminants into the disposal tank 310 from an outside thereof. A water tank 360 is installed at a lower part of the disposal tank 310.

Figure 8:
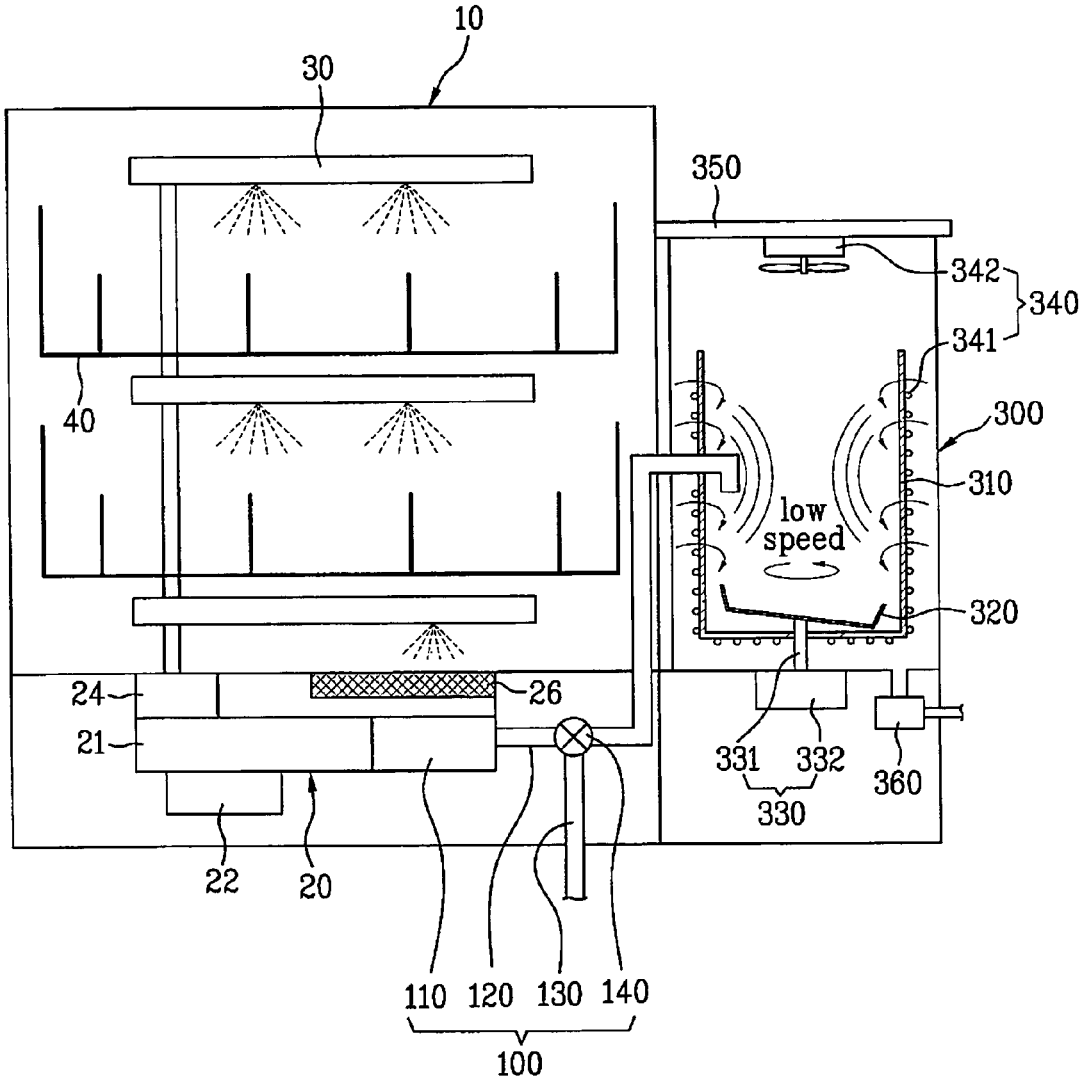
FIG. 8 illustrates a cross sectional view showing a dehydrating process of the dishwasher of FIG. 7.

Referring to FIG. 8, the drying process of the contaminant disposal part in accordance with the second embodiment of the dishwasher will be descried. When the drying process is started, the stirrer 320 is rotated along with the driving device 330 so as to mix contaminants in the disposal tank 310.

In this instance, the stirrer is rotated at a relatively low speed compared to the rotation speed of the stirrer and the disposal tank during the dehydration process in the first embodiment. Contrary to the first embodiment, the dehydrating process is not performed in the second embodiment.

When the drying heater is supplied with electricity, an induced current is generated at a working coil included in the drying heater, and heat is generated by the induction current. The generated heat is rapidly transmitted to the whole disposal tank 310 so as to evenly heat the disposal tank.

The heated disposal tank 310 directly comes in thermal contact with contaminants that is stirred by the stirrer 32. Accordingly, a heat contact area between the disposal tank and contaminants is increased and thus effect of the heat transmission is increased.

Heat loss is also decreased compared to a conventional hot-air dry method. Drying efficiency of the induction heating method is increased to 80-90% compared to the hot-air drying method.

Figure 9:
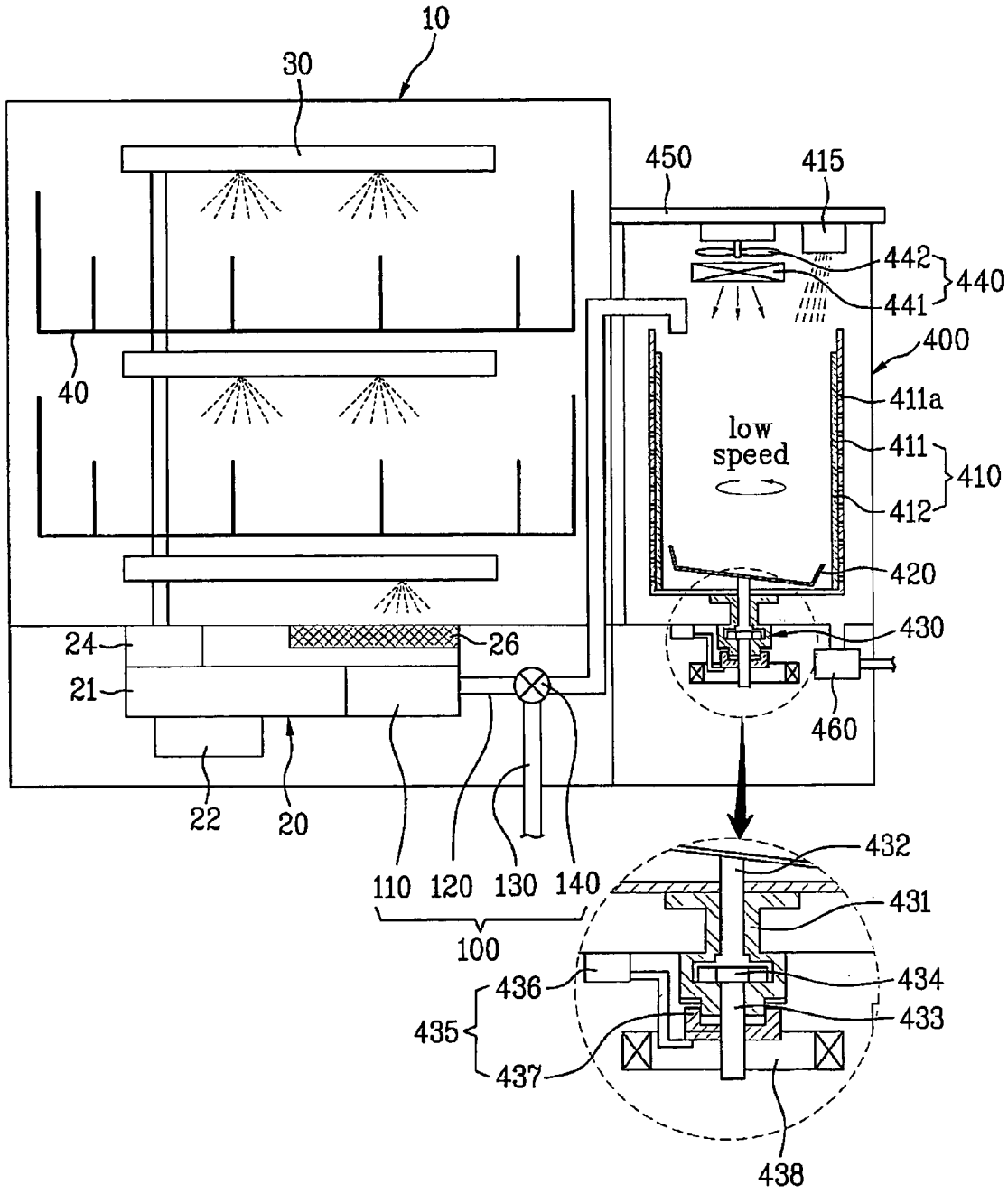
FIG. 9 illustrates a cross sectional view showing a third embodiment of the dishwasher in accordance with the present invention.

Referring to FIG. 9, a third embodiment of the dishwasher in accordance with the present invention will be described. The third embodiment of the dishwasher in accordance with the present invention includes a washing part 10 for spraying wash water to wash dishes and filtering contaminants, a draining part 100 for draining contaminants and wash water in the washing part, and a contaminant disposal part 400 for fermenting contaminants discharged from the draining part.

Structural elements of the washing part 10 and the draining part 100 are substantially the same as those of the dishwasher described in the prior art, and thus description of which will be omitted.

The contaminant disposal part 400 includes a disposal tank 410 for accommodating contaminants discharged from the draining part, a stirrer 420 for mixing contaminants stored in the disposal tank, a fermentative bacteria inserting device for introducing fermentative bacteria into the disposal tank, a driving device 430 for rotating the stirrer and the disposal tank, and a heating device 440 for maintaining the contaminants at a predetermined temperature so as to ferment the contaminants introduced into the disposal tank.

In this case, the disposal tank 410 includes a body 411 and a screen 412, and the driving device 430 includes a dehydrating axis 431, stirring axes 432 and 433, a speed reducer 434, a clutching device 435 and a driving motor 438. The structural elements of the disposal tank 410, the driving device 430 and the stirrer 420 are substantially the same as those of the first embodiment, and thus description of which will be omitted.

The fermentative bacteria inserting device 415 is installed at an upper part of the contaminant disposal part so as to supply fermentative bacteria to the contaminants when the contaminants stored in the disposal tank 410 are dried. The fermentative bacteria inserting device 415 may of course be installed at a predetermined position such as a side of the contaminant disposal part. The fermentative bacteria may be supplied during removal of moisture included in the contaminants.

The heating device 440 includes a fermenting heater 441 installed at an upper part of the disposal tank 410 and generating heat, and a fan 442 for blowing the heat from the heater into the disposal tank 410. In this instance, the fermenting heater 441 provides a proper temperature for fermenting the contaminants. The temperature of the disposal tank heated by the fermentative heater is set properly according to a kind of bacteria.

The fermenting heater 441 generates relatively low temperature heat compared to the drying heater of the first and second embodiments, and thus may have a smaller capacity. The disposal tank 410 may include a relatively low heatproof material compared to the first and second embodiments of the disposal tank 410.

In the third embodiment of the dishwasher mentioned above, washing, discharging, draining, and dehydrating processes are relatively the same as the first embodiment, and thus description of which will be omitted. Drying process of the third embodiment will be described. When the drying process is started, fermentative bacteria inserting device 415 supplies fermentative bacteria into the disposal tank 410. The stirrer 420 is rotated so as to stir contaminants stored in the disposal tank 410. In this instance, the stirrer 420 is operated at a speed lower than rotation speed of the stirrer.

Power is supplied to the fermenting heater 441, and consequently heat is generated. The fan 442 is rotated, and consequently heat is supplied from the fermenting heater to contaminants. Then, the contaminants stored in the disposal tank 410 are stirred and fermented for a predetermined period of time.

A controlling method for the third embodiment of the dishwasher mentioned above is mostly the same as the controlling method for the first embodiment except that a process of supplying fermentative bacteria for fermenting contaminants to the disposal tank is added in the step of drying contaminants that are stored in the contaminant disposal part.

Figure 10:
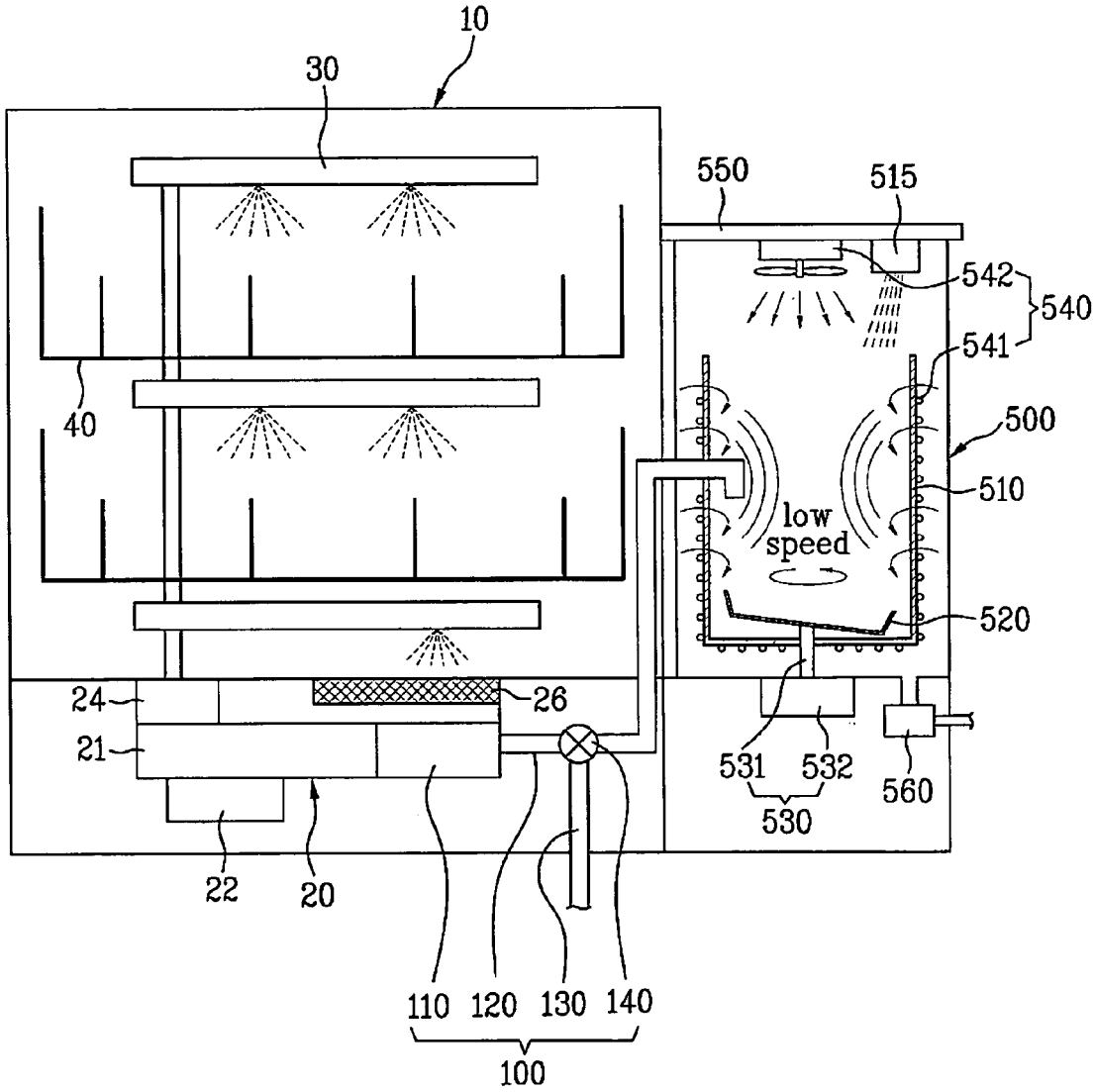
FIG. 10 illustrates a cross sectional view showing a fourth embodiment of the dishwasher in accordance with the present invention.

Referring to FIG. 10, a fourth embodiment of the dishwasher in accordance with the present invention will be described. In this case, structures of the washing part 10 and the draining part are substantially the same as the second embodiment, and thus description of which will be omitted.

A contaminant disposal part 500 includes a disposal tank 510 for accommodating contaminants discharged from the draining part 100, a stirrer 520 for mixing the contaminants stored in the disposal tank, a driving device 530 for rotating the stirrer, and a heating device 540 for maintaining the contaminants at a predetermined temperature so as to ferment the contaminants inserted into the disposal tank.

Structures of the disposal tank 510, the stirrer 520, the fermentative bacteria inserting device 515, and the driving device 530 are substantially the same as those of the second and third embodiments, and thus description of which will be omitted.

The heating device 540 is attached to an outer surface of the disposal tank and includes a fermenting heater 541 for heating the disposal tank 510, and a fan 542 for circulating air in the disposal tank. The heating device includes only a fermenting heater.

The fermenting heater desirably heats the disposal tank 510 by an induction heating method. Meanwhile, like the second embodiment mentioned above, a separate dehydrating process is not performed in the present invention. When a drying process is started, the fermentative bacteria inserting device 515 supplies fermentative bacteria into the disposal tank 510, and the driving device 530 rotates only the stirrer 520 at a low speed.

The heating device maintains the disposal tank at a proper temperature so as to ferment contaminants in the disposal tank. Then, contaminants in the disposal tank are stirred for a predetermined period of time so as to be fermented.

Effects of the dishwasher in accordance with the present invention will be described. First, according to the present invention, environmental pollution is minimized by installing a contaminant disposal part that enables drying or fermenting contaminants. Therefore, there is no need to empty filtered contaminants every dishwashing time. Second, according to the present invention, contaminants are dried or fermented and thereby prevented from decaying. Therefore, there is an effect of using the dishes sanitarily. Third, according to the present invention, due to a cover installed at the contaminant disposal part, contaminants are disposed from outside of the contaminant disposal part and then dried or fermented to be stored. Fourth, according to the present invention, a drying time is reduced by drying contaminants after moisture contained in the contaminants is removed. Therefore, energy consumption is reduced. Fifth, according to the present invention, a capacity and a manufacturing cost of the heater are reduced by using a heater discharging a low temperature heat.

It will be apparent to those skilled in the art that various modifications and variations can be made in the present invention without departing from the spirit or scope of the inventions. Thus, it is intended that the present invention covers the modifications and variations of this invention provided they come within the scope of the appended claims and their equivalents.

What is claimed is:

1. A dishwasher comprising:

a washing part comprising:

a sump for accommodating wash water for washing contaminated dishes, a washing pump for pumping wash water accommodated in the sump, and a filtering member for filtering contaminants contained in the wash water;

a draining part for draining contaminants and wash water filtered by the washing part; and a contaminant disposal part configured for drying contaminants discharged from the draining part, the contaminant disposal part comprising a disposal tank for accommodating contaminants discharged from the draining part, a stirrer for mixing contaminants in the disposal tank, a driving device for rotating the stirrer, and a heating device for drying the contaminants.

2. The dishwasher of claim 1, wherein the draining part comprises:

a draining pump connected with the washing part;

a first draining hose for discharging the contaminants and wash water collected at the draining pump to the contaminant disposal part;

a second draining hose for discharging wash water from the draining pump outside the dishwasher; and a channel control valve for selectively supplying the wash water to the first draining hose and the second draining hose.

3. The dishwasher of claim 2, wherein the second draining hose is installed at a predetermined portion of the first draining hose, and the channel control valve is installed at a coupling part of the first and second draining hoses.

4. The dishwasher of claim 2, wherein the disposal tank comprises a water tank at a lower part thereof so as to collect moisture discharged from the disposal tank.

5. The dishwasher of claim 1, wherein the driving device rotates the stirrer and the disposal tank at the same time.

6. The dishwasher of claim 1, wherein the disposal tank comprises:

a body having a plurality of through holes; and a screen installed at a side of the body to discharge moisture contained in the contaminants.

7. The dishwasher of claim 1, wherein the heating device comprises:

a drying heater installed at an upper part of the disposal tank and generating heat; and a fan for blowing heat from the drying heater into the disposal tank.

8. The dishwasher of claim 1, wherein the heating device comprises:

a drying heater attached to an outer surface of the disposal tank to heat the disposal tank; and a fan for circulating air in the disposal tank.

9. The dishwasher of claim 1, wherein the contaminant disposal part further comprises a cover to be opened or closed for throwing contaminants into the disposal tank.

10. A dishwasher comprising:

a washing part comprising:

a sump for accommodating wash water for washing contaminated dishes;

a washing pump for pumping wash water from the sump;

a filtering member for filtering contaminants included in the wash water;

a draining part for draining contaminants and wash water filtered by the washing part; and a contaminant disposal part for fermenting contaminants discharged from the draining part, the contaminant disposal part comprising a disposal tank for accommodating contaminants discharged from the draining part, a stirrer for mixing contaminants in the disposal tank, a fermentative bacteria inserting device for inserting fermentative bacteria into the disposal tank, a driving device for rotating the stirrer, and a heating device for maintaining the contaminants at a predetermined temperature so as to ferment the contaminants received in the disposal tank.

11. The dishwasher of claim 10, wherein the draining part comprises:

a draining pump connected with the washing part;

a first draining hose for discharging the contaminants and wash water collected at the draining pump to the contaminant disposal part;

a second draining hose for discharging wash water from the draining pump to an outside of the dishwasher; and a channel control valve for selectively supplying the wash water to the first draining hose and the second draining hose.

12. The dishwasher of claim 10, wherein the driving device rotates the stirrer and the disposal tank at the same time.

13. The dishwasher of claim 10, wherein the disposal tank comprises:

a body having a plurality of through holes; and a screen installed at a side of the body to discharge moisture contained in the contaminants.

14. The dishwasher of claim 10, wherein the heating device comprises:

a drying heater installed at an upper part of the disposal tank and generating heat; and a fan for blowing heat from the drying heater into the disposal tank.

15. The dishwasher of claim 10, wherein the heating device comprises:

a drying heater attached to an outer surface of the disposal tank to heat the disposal tank; and a fan for circulating air in the disposal tank.

16. A dishwasher comprising:

a washing part comprising:

a sump for accommodating wash water for washing contaminated dishes, a washing pump for pumping wash water accommodated in the sump, and a filtering member for filtering contaminants contained in the wash water;

a draining part comprising a draining pump connected with the washing part, for draining contaminants and wash water filtered by the washing part; and a contaminant disposal part for accommodating contaminants discharged from the draining pump, the contaminant disposal part comprising a disposal tank for accommodating contaminants discharged from the draining part, a stirrer for mixing contaminants in the disposal tank, a driving device for rotating the stirrer, and a heating device for drying the contaminants.

17. The dishwasher of claim 16, the draining part further comprising:

a first draining hose for discharging the contaminants and wash water collected at the draining pump to the contaminant disposal part;

a second draining hose for discharging wash water from the draining pump outside the dishwasher; and a channel control valve for selectively supplying the wash water to the first draining hose and the second draining hose.

18. The dishwasher of claim 16, wherein the disposal tank comprises:

a body having a plurality of through holes; and a screen installed at a side of the body to discharge moisture contained in the contaminants.

19. The dishwasher of claim 16, wherein the contaminant disposal part further comprises a cover openable and closable for throwing contaminants into the disposal tank.

* * * * *